United States Patent [19]

Johnson

[11] Patent Number: 4,512,047

[45] Date of Patent: Apr. 23, 1985

[54] SUPPORT CUSHION

[76] Inventor: Violet M. Johnson, 21 Kelly Cir., Katonah, N.Y. 10536

[21] Appl. No.: 530,148

[22] Filed: Sep. 7, 1983

[51] Int. Cl.[3] ..... A47G 9/00; A61G 7/06

[52] U.S. Cl. ..... 5/432; 297/231

[58] Field of Search ..... 5/432, 433, 431, 437; 297/219, 230, 231; D6/201

[56] References Cited

U.S. PATENT DOCUMENTS

| | | | |
|---|---|---|---|
| D. 159,483 | 8/1950 | Glassman | D6/201 |
| 2,237,057 | 4/1941 | Meyer | 297/219 |
| 2,250,267 | 7/1941 | Lins | 5/431 |
| 2,769,485 | 4/1956 | Shapiro | 5/432 |
| 3,273,174 | 9/1966 | Cassini | 5/432 |
| 4,031,578 | 6/1977 | Sweeney et al. | D6/201 |

FOREIGN PATENT DOCUMENTS

| | | | |
|---|---|---|---|
| 599871 | 4/1948 | United Kingdom | 5/433 |

*Primary Examiner*—Alexander Grosz

*Attorney, Agent, or Firm*—Jordan and Hamburg

[57] ABSTRACT

A support cushion adapted to be located on a sitting material for gently supporting a person comprises a central section having a flat back portion and a front portion, and two bolsters foldably connected to the vertical side edges of the back portion of the central section. Two slits are respectively formed at the bottom between each bolster and the central section. The central section includes a lower part and an upper part thinner than the lower part so that the front portion gradually rearwardly extends from the lower part toward the upper part thereof.

2 Claims, 4 Drawing Figures

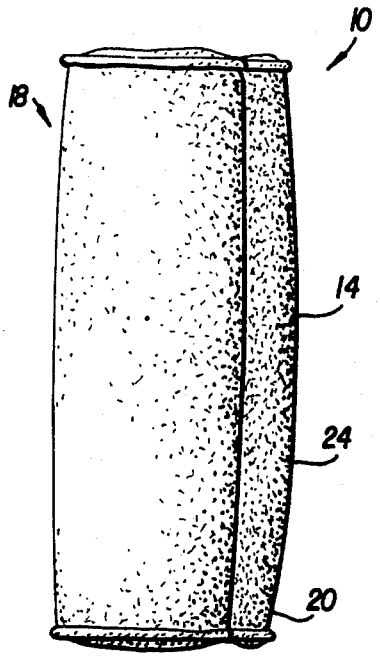
FIG. 3
FIG. 4
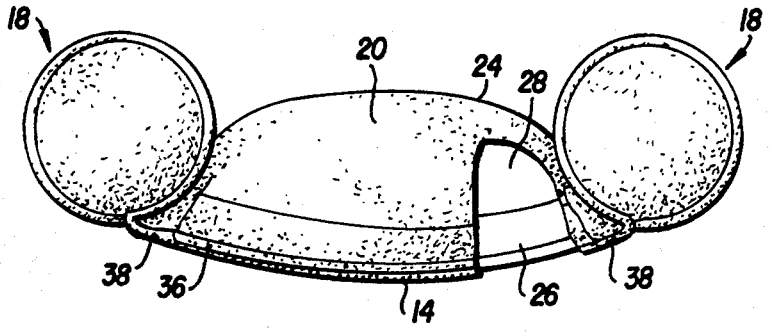

SUPPORT CUSHION

BACKGROUND OF THE INVENTION AND INFORMATION DISCLOSURE STATEMENT

The present invention relates to a support cushion to be disposed on a chair or a seat for gently supporting a person sitting thereon. Especially, the support cushion of the invention is designed to provide lateral as well as back support for a hospitalized or invalid person who is unable to support himself in a sitting position.

A healthy person can freely move by himself, and for example, when he sits on a chair, he controls himself without effort not to fall down from the chair. However, some patients can not even move by themselves, and require the aid of other persons even to assume a sitting position. If these patients sit on chairs, they can not hold their sitting position. Namely, they may fall down from the chairs if they lose their balance. It is, however, important to let these patients move away from their beds and sit on chairs for the benefit of their health, such as to prevent the patients from suffering bedsores. Presently, in hospitals, such patients are held in chairs by straps to prevent the patients from accidentally falling from the chairs.

When a patient sits on a chair, a cushion may be situated between the patient's back and the chair to make him comfortable. Further, it is preferable to support side portions of the patient so that the patient can be securely and comfortably held on the chair.

U.S. Pat. No. De 159,483 discloses a baby sit-up cushion, which comprises a central portion in the form of a triangular column, and two semi-circular side members connected to the central portion. The central portion should be located at a corner, such as of a sofa, crib and so on. Otherwise, the two side members can not be located properly relative to the central portion for supporting a baby in position. It is to be noted that the baby sit-up cushion can not be used for supporting a patient on a chair due to its structure.

U.S. Pat. Nos. 3,197,255 and 3,348,880 disclose back supports, but they are different in structure from the cushion of the present invention and are not suitable to support patients on chairs.

Accordingly, an object of the invention is to provide a support cushion which can be located on a seat or a chair to gently support a patient thereat.

Another object of the invention is to provide a support cushion as stated above, which is simple and can be formed easily.

Further objects and advantages of the invention will be apparent from the following description of the invention.

SUMMARY OF THE INVENTION

In accordance with the invention, there is provided a support cushion adapted to be located on a sitting means, such as a chair or a seat, for gently supporting a person. The support cushion comprises a central section having a flat back portion and a front portion, and two bolsters foldably connected to the respective vertical side edges of the back portion of the central section. Respective slits are formed at the bottom between each bolster and the central section. The central section includes a lower part and an upper part thinner than the lower part so that the front portion gradually rearwardly extends from the lower part toward the upper part thereof. Consequently, the central section and two bolsters respectively support the back and two side portions of a person. Further, the body of the person can be firmly tightened to the sitting means by a strap which engages the body of the person and extends to the sitting means through the slits.

The support cushion is preferably provided with a cover having a center and two side portions. The central section and two bolsters are separately formed on a resilient material and are held in the center and two side portions of the cover respectively. The slits are formed in the cover between the center portion and the respective side portions.

BRIEF DESCRIPTION OF THE DRAWINGS

FIG. 3 is a side view of the cushion; and

FIG. 4 is a bottom view of the cushion, in which the cover is partly broken to show inside the cushion.

DETAILED DESCRIPTION OF A PREFERRED EMBODIMENT

Figure 1:
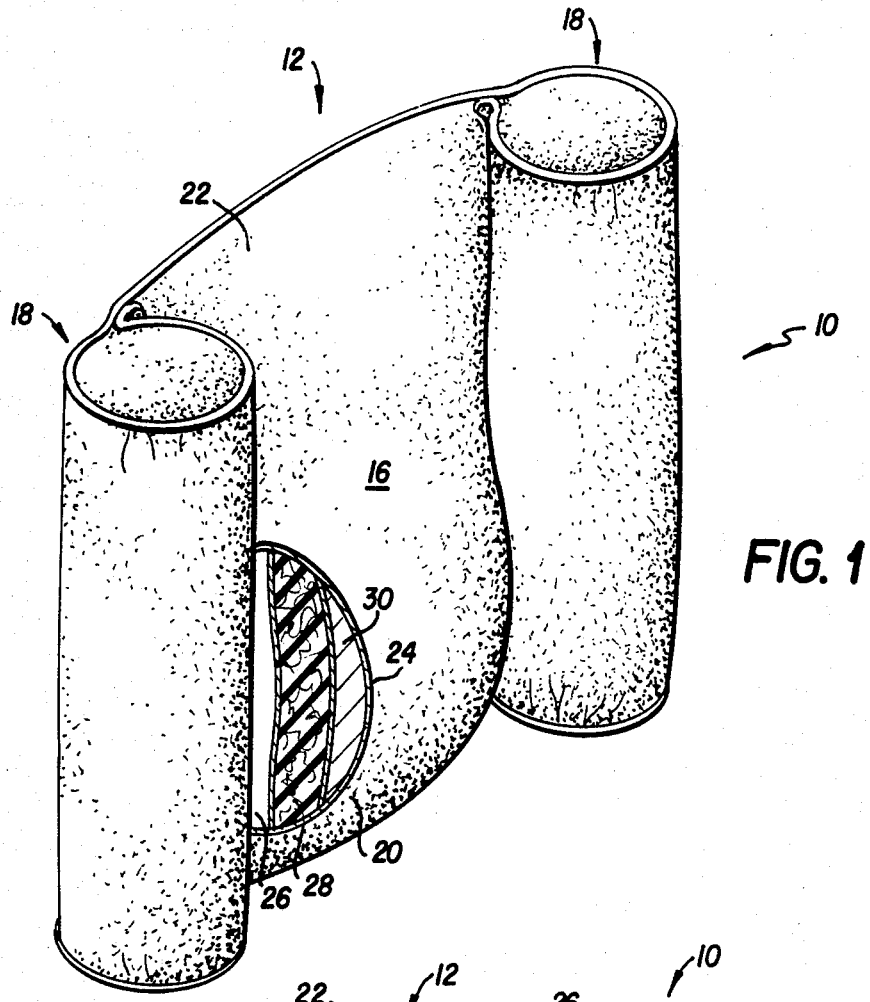
FIG. 1 is a perspective view of a support cushion in accordance with the present invention, in which the cover is partly broken to show inside the cushion.
Figure 2:
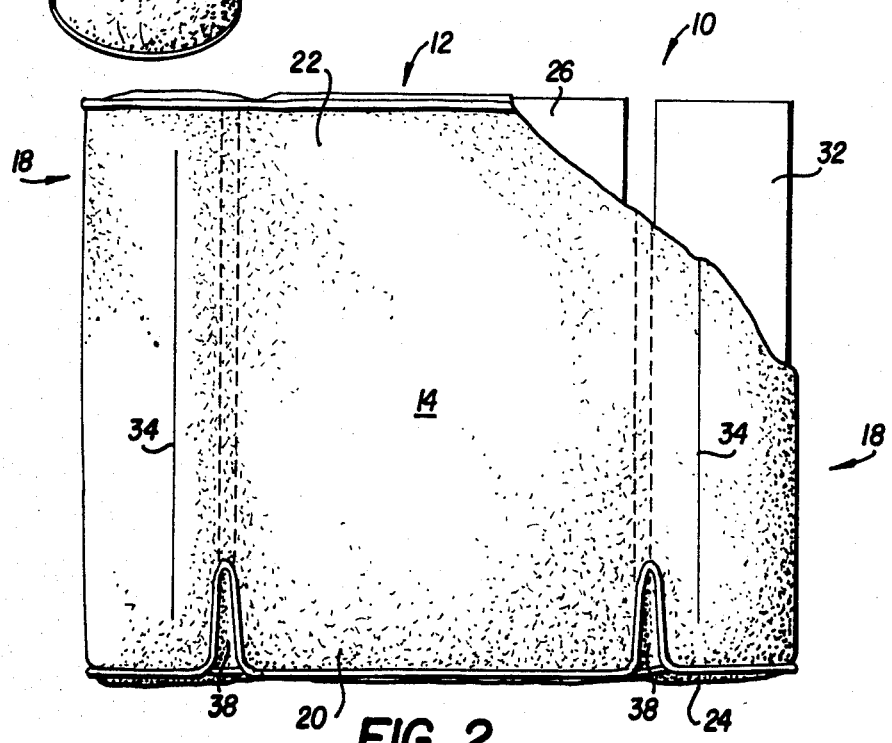
FIG. 2 is a rear view of the cushion, in which the cover is partly broken to show inside the cushion.

Referring to FIGS. 1–4, a support cushion 10 in accordance with the present invention is shown. The cushion 10 is designed to be put on a sitting means, such as a chair, seat or sofa so that the cushion 10 can be supported by a back of the sitting means.

The cushion 10 is composed of three sections, namely a central section 12 having a flat back portion 14 and a front portion 16, and two bolsters 18 connected to the vertical side edges of the central section 12. The central section 12 includes a lower part 20 and an upper part 22 thinner than the lower part 20. Namely, the front portion 16 substantially rearwardly extends from the lower part 20 toward the upper part 22. When a person sits on a chair and leans against the cushion 10, the waist portion and the back portion of the person can be supported by the lower part 20 and the upper part 22 respectively.

The bolsters 18 are substantially cylindrical and are connected to the vertical side edges of the central section 12. The diameter of the bolster 18 is greater than the thickness of the lower part 20 of the central section. Therefore, when the person leans against the cushion 10, the two bolsters 18 support the body of the person.

Practically, the central section 12 and two bolsters 18 are separately made and are integrally connected by a cover 24 so that one piece cushion 10 is formed. The central section 12 is made of a central core 26 which is rectangular and flat and extends from the lower part 20 to the upper part 22 along the flat back portion 14, and a bottom core 28 disposed in a bag 30 connected to the lower part 20 of the front portion 16. Therefore, when a person leans against the cushion 10, the central bore 26 and the bottom core 28 do not move in the cover 24 and stay therein to properly support the back and waist portions of the person. Preferably, the central core 26 is made of a foam rubber and the bottom core 28 is made of fibers.

Each bolster 18 is made of a side core 32 in the form of a cylindrical column. The bolster 18 is preferably made of a foam rubber.

The cover 24 is provided with side slits 34 at two side portions, and a bottom slit 36 at the center portion thereof for respectively inserting the side cores 32 and the central core 26 therethrough. The slits 34, 36 are closed by fasteners (not shown).

The cover 24 further includes two slits 38 at a lower part thereof, which are respectively formed between the central section 12 and the bolster 18. The slits 38 are especially important for supporting an invalid who is unable to support himself in a sitting position. When such an invalid sits on a chair, the body of that person has to be fastened to the back of the chair by means of a strap so that the person does not fall from the chair. The strap may pass through the slits 38 and passes across the front of the person's body and is fastened to the chair.

Since the cushion 10 is provided with two bolsters 18, the body of a person is well supported between the bolsters 18. This support is very helpful in addition to the supporting provided by the strap. Consequently, the person can be well held in position by the support cushion 10 of the invention.

While the invention has been explained with reference to a specific embodiment, it is to be noted that the description is illustrative and the invention is limited only by the appended claims.

What is claimed is:

1. A support cushion adapted to be located on a sitting means for gently supporting a person comprising, a cover having a center portion and two side portions connected to the center portion, said cover including two slits at a bottom between the center portion and the side portion, respectively, adapted to permit a strap to pass therethrough, a central section to be situated inside the center portion of the cover, said central section including a flat back portion and a front portion and being divided into a lower part and an upper part, said central section being formed of a rectangular central core extending from the lower part to the upper part along the flat back portion and a bottom core connected to the lower part of the front portion so that the front portion gradually rearwardly extends from the lower part toward the upper part thereof and the central core and the bottom core do not move in the cover and stay therein to properly support the back and waist portions of the person, and two cylindrical bolsters having height substantially the same as the central section, said bolters being arranged vertically relative to the central section and situated inside the side portions of the cover so that the central section and two bolsters respectively support the back and two side portions of a person, and the body of the person can be firmly tightened to the sitting means by the strap which passes across the front of the person and extends to the sitting means through the slits.

2. A support cushion adapted to be located on a sitting means for gently supporting a person comprising, a cover having a center portion and two side portions connected to the center portion, said cover including two slits at a bottom between the center portion and the side portion, respectively, adapted to permit a strap to pass therethrough, a central section to be situated inside the center portion of the cover, said central section including a flat back portion and a front portion and being divided into a lower part and an upper part, said central section being formed of a rectangular central core extending from the lower part to the upper part along the flat back portion and a bottom core, said bottom core including a bag connected to the lower part of the front portion and a core material disposed inside the bag so that the front portion gradually rearwardly extends from the lower part toward the upper part thereof, and the central core and the bottom core do not move in the cover and stay therein to properly support the back and waist portions of the person, and two cylindrical bolsters having height substantially the same as the central section, said bolsters being arranged vertically relative to the central section and situated inside the side portions of the cover so that the central section and two bolsters respectively support the back and two side portions of a person, and the body of the person can be firmly tightened to the sitting means by the strap which passes across the front of the person and exends to the sitting means through the slits.

* * * * *